US011063357B2

(12) United States Patent
Leung et al.

(10) Patent No.: US 11,063,357 B2
(45) Date of Patent: Jul. 13, 2021

(54) DUAL-BAND ANTENNA FOR GLOBAL POSITIONING SYSTEM

(71) Applicant: City University of Hong Kong, Kowloon (HK)

(72) Inventors: Kwok Wa Leung, Kowloon (HK); Yuxiang Sun, Kowloon (HK); Jian Ren, Kowloon (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/430,530

(22) Filed: Jun. 4, 2019

(65) Prior Publication Data

US 2020/0388918 A1 Dec. 10, 2020

(51) Int. Cl.

| | |
|---|---|
| ***H01Q 9/16*** | (2006.01) |
| ***H01Q 21/26*** | (2006.01) |
| ***H01Q 5/307*** | (2015.01) |
| ***H01Q 9/26*** | (2006.01) |
| ***H01Q 1/24*** | (2006.01) |

(52) U.S. Cl.

CPC ..... *H01Q 5/307* (2015.01); *H01Q 1/24* (2013.01); *H01Q 9/16* (2013.01); *H01Q 9/265* (2013.01); *H01Q 21/26* (2013.01)

(58) Field of Classification Search

CPC ..... H01Q 13/02; H01Q 5/30; H01Q 5/307; H01Q 19/24; H01Q 21/24; H01Q 21/26; H01Q 9/16; H01Q 1/52; H01Q 9/26; H01Q 9/265; H01Q 1/24; H01Q 1/523; H01Q 21/08; H01Q 21/28; H01Q 25/00; H01Q 25/001; H01Q 9/42

See application file for complete search history.

(56) References Cited

U.S. PATENT DOCUMENTS

| | | | | |
|---|---|---|---|---|
| 4,218,685 | A * | 8/1980 | Frosch | H01Q 1/28 343/727 |
| 4,504,836 | A * | 3/1985 | Seavey | H01Q 21/245 333/21 A |
| 5,461,394 | A * | 10/1995 | Weber | H01Q 13/0258 343/776 |
| 5,534,882 | A | 7/1996 | Lopez | |
| 6,542,119 | B2 | 4/2003 | Howell et al. | |
| 7,714,785 | B2 | 5/2010 | Hsu et al. | |
| 8,049,667 | B2 | 11/2011 | Lackey | |
| 9,130,275 | B2 | 9/2015 | Liu | |
| 2009/0204372 | A1* | 8/2009 | Johnston | H01Q 13/08 702/191 |
| 2011/0260941 | A1* | 10/2011 | Jones | H01Q 9/0435 343/776 |
| 2011/0279339 | A1* | 11/2011 | Johnston | H01Q 19/10 343/786 |

* cited by examiner

*Primary Examiner* — Tho G Phan

(74) *Attorney, Agent, or Firm* — Renner Kenner Greive Bobak Taylor & Weber

(57) ABSTRACT

A dual-band antenna for global positioning system includes a plurality of dipole antenna arranged to operate in a L1 band and a L2 band; a back cavity structure mounted to the plurality of dipole antennas, wherein the plurality of dipole antennas are at least partially accommodated within a back cavity defined by the back cavity structure; and a feed network provided on the back cavity structure and coupled to the plurality of dipole antennas.

21 Claims, 16 Drawing Sheets

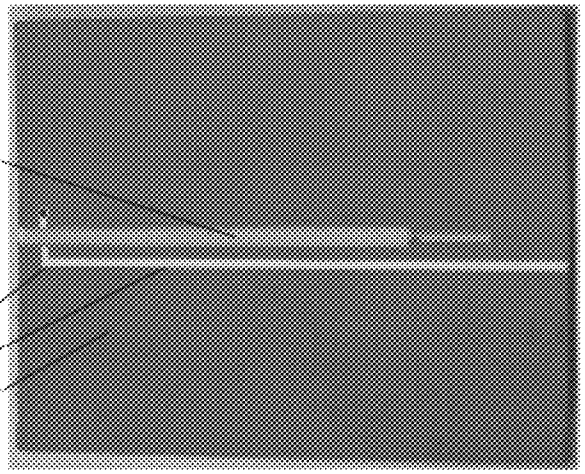
FIG. 4C
FIG. 4D
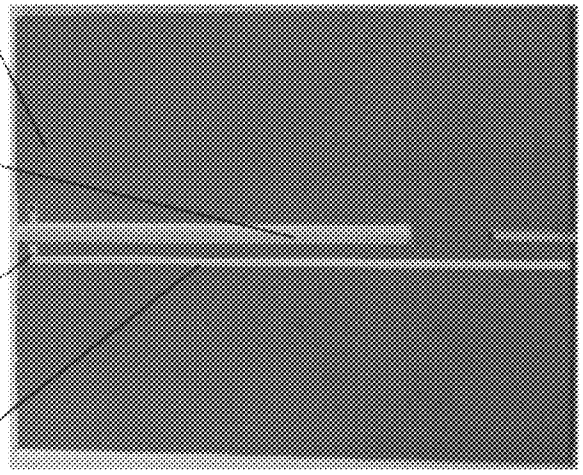
FIG. 4E
FIG. 4F

DUAL-BAND ANTENNA FOR GLOBAL POSITIONING SYSTEM

TECHNICAL FIELD

The present invention relates to a dual-band antenna, and particularly, although not exclusively, to a dual-band antenna for global positioning system.

BACKGROUND

In a radio signal communication system, information is transformed to radio signal for transmitting in form of an electromagnetic wave or radiation. These electromagnetic signals are further transmitted and/or received by suitable antennas.

Some wireless applications may require simultaneous communication of radio signals in more than one frequency bands to improve the performance of these applications, which therefore may require a deployment of multiple units of antennas with different designs in a single system or apparatus.

SUMMARY OF THE INVENTION

In accordance with a first aspect of the present invention, there is provided a dual-band antenna for global positioning system comprising: a plurality of dipole antenna arranged to operate in a L1 band and a L2 band; a back cavity structure mounted to the plurality of dipole antennas, wherein the plurality of dipole antennas are at least partially accommodated within a back cavity defined by the back cavity structure; and a feed network provided on the back cavity structure and coupled to the plurality of dipole antennas.

In an embodiment of the first aspect, the plurality of dipole antennas includes a plurality of cross-dipole antennas.

In an embodiment of the first aspect, the plurality of dipole antennas are arranged communicate an electromagnetic signal with circular polarization.

In an embodiment of the first aspect, the plurality of cross-dipole antennas comprises a plurality of dipole arms including at least one first dipole arm and at least one second dipole arm, wherein the first dipole arm has a dimension different from that of the second dipole arm.

In an embodiment of the first aspect, each of the plurality of dipole arms includes a curved structure, wherein the first dipole arm and the second dipole arm are defined with two different subtended angles and radii so as to operate in the L1 band and the L2 band respectively.

In an embodiment of the first aspect, the plurality of cross-dipole antennas are provided on at least one antenna substrate mounted to the back cavity structure.

In an embodiment of the first aspect, each of the at least one antenna substrate is provided with the plurality of dipole arms defined on a first side of the respective antenna substrate.

In an embodiment of the first aspect, the plurality of dipole arms couple to a slot feeder defined on the respective antenna substrate.

In an embodiment of the first aspect, the antenna comprises two antenna substrates intersecting with each other.

In an embodiment of the first aspect, the two antenna substrates and a base of the back cavity structure are orthogonally arranged.

In an embodiment of the first aspect, each of the at least one antenna substrate is provided with a joining structure arranged to cooperate with another joining structure in another antenna substrate.

In an embodiment of the first aspect, the joining structure includes a slit formed on the each of the at least one antenna substrate.

In an embodiment of the first aspect, each of the at least one antenna substrate is provided with a ground plane on the first side of the substrate.

In an embodiment of the first aspect, each of the at least one antenna substrate is further provided with a microstrip feedline on a second side of the substrate, wherein the second side opposites to the first side.

In an embodiment of the first aspect, the back cavity structure defines a corrugated back cavity.

In an embodiment of the first aspect, the back cavity structure comprises a side wall in a corrugated shape.

In an embodiment of the first aspect, the feed network includes a two-stage cascaded hybrid coupler.

In an embodiment of the first aspect, feed network is defied with a first set of ports coupled to the plurality of dipole antennas and a second set of ports coupled to external connectors mounted on the back cavity structure.

In an embodiment of the first aspect, the first set of ports are defined on a base of the back cavity structure proximate to a center position of the base, and the second set of ports are defined proximate to an edge position of the base.

In an embodiment of the first aspect, the feed network is defined with a folded side length between a proximate pair of ports in one of the first set of ports and one of the second set of ports.

In an embodiment of the first aspect, the feed network is provided on a bottom surface of a base of the back cavity structure, the feed network is coupled to the plurality of dipole antennas provided on an opposite surface of the base through a plurality of via structures.

In an embodiment of the first aspect, the electromagnetic signal includes a radiation pattern substantially covering the upper hemisphere in both xoz-plane and yoz-plane.

In an embodiment of the first aspect, the electromagnetic signal includes a 3-dB axial ratio beamwidth broader than 200°.

In an embodiment of the first aspect, the L1 band and the L2 band includes a 1.575 Ghz wireless communication band and a 1.227 Ghz wireless communication band respectively.

In accordance with a second aspect of the present invention, there is provided an antenna assembly comprising a plurality of multi-band antenna in accordance with the first aspect arranged in an array.

BRIEF DESCRIPTION OF THE DRAWINGS

Embodiments of the present invention will now be described, by way of example, with reference to the accompanying drawings in which:

FIGS. 4C to 4F are top and bottom view of the two antenna substrates of the antenna of FIG. 4A;

DETAILED DESCRIPTION OF THE PREFERRED EMBODIMENT

The inventors have, through their own research, trials and experiments, devised that global positioning system (GPS) may be deployed in different applications, such as military, commercial, and civilian applications. Circular polarization (CP) may be used in GPS because CP-based system may suppress multipath fading problem. Preferably, as compared with the linearly polarized antenna, CP antennas may be less sensitive to the angle between the transmitting and receiving antennas.

For GPS systems, antennas are necessary to facilitate wireless communication of electromagnetic signals between devices. To obtain higher precision, it may be preferable for antennas to have broad AR beamwidths that can cover the upper hemisphere to effectively receive low-elevation satellite signals. In some example embodiments, different frequency bands may be used in various GPS applications. For example, L1 (1.575 GHz) and L2 bands (1.227 GHz), may be used by satellites and it is therefore desirable to include them in GPS antenna designs.

In one example embodiment, quadrifilar helix antennas (QHA) with cardioid-shaped radiation patterns and broad gain beamwidths may be used for GPS applications. However, it is inconvenient to fabricate their curl arms and the fabrication tolerance may affect the antenna performance significantly. Furthermore, more than one QHA are needed for a dual-band design, which may increase the complexity of the antenna structure.

Alternatively, some systems may employ planar cross-dipole antennas for wideband and dual-/multi-band CP applications. By taking advantage of the inherent phase difference between the signal line and ground plane, the sequential rotation feed network can be simplified considerably. Also, the artificial magnetic conductor or high impedance surface can be incorporated into the antenna structures to reduce the antenna profile or enhance the front-to-back ratio. However, the AR beamwidths of planar cross-dipole antennas may be insufficient to fully cover the upper hemisphere.

In one preferable embodiment, a dual-band CP cross-dipole antenna with wide AR beamwidth that fully cover the upper hemisphere is provided. The antenna has unequal dipole-arm lengths to obtain two operating bands. A very wide CP beamwidth of more than 200° may be achieved by using curved dipole arms and a corrugated cavity.

Figure 1:
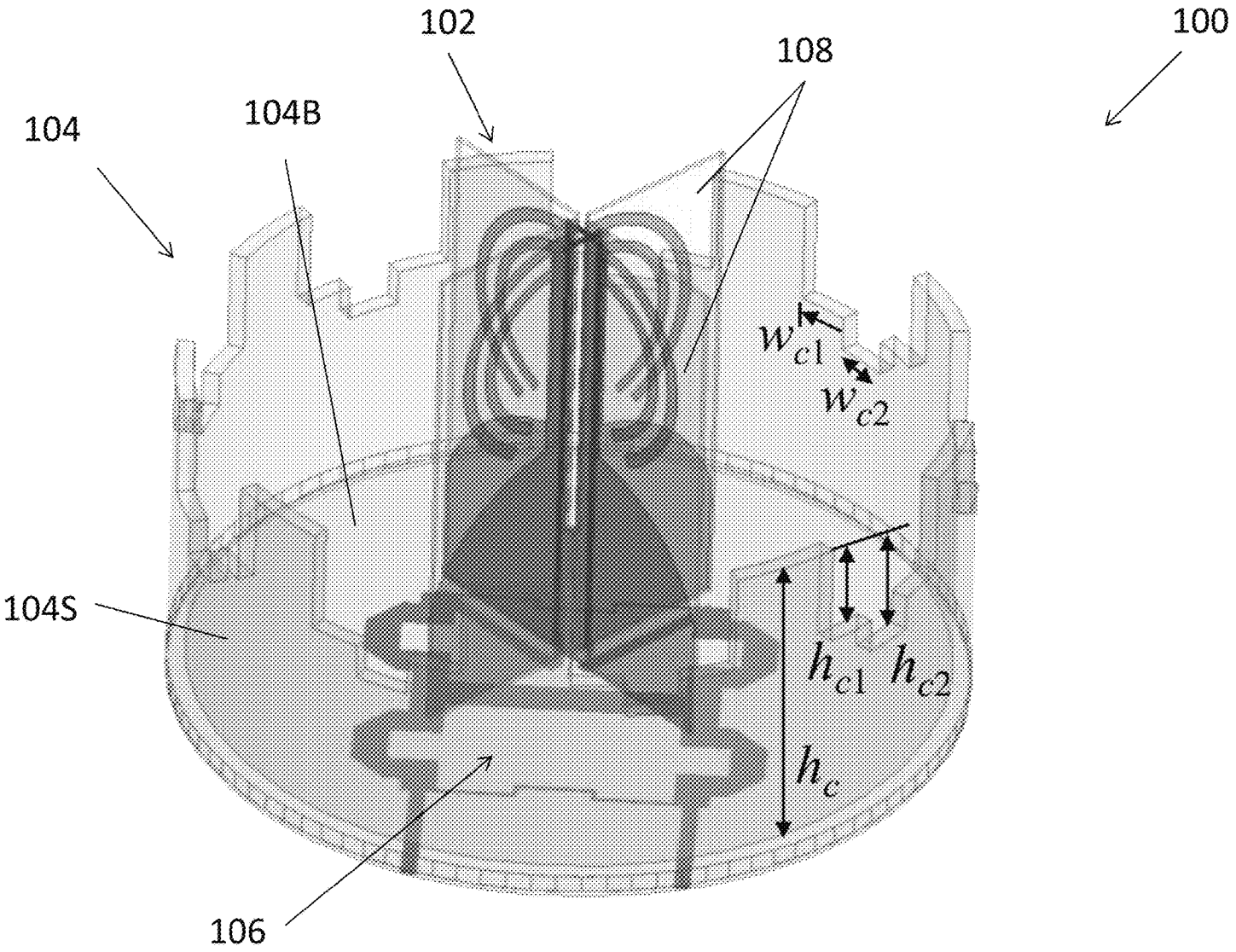
FIG. 1 is a perspective view of a dual-band antenna in accordance with one embodiment of the present invention.

With reference to FIG. 1, there is shown an example embodiment of a dual-band antenna 100 for global positioning system, comprising: a plurality of dipole antenna 102 arranged to operate in a L1 band and a L2 band; a back cavity structure 104 mounted to the plurality of dipole antennas 102, wherein the plurality of dipole antennas 102 are at least partially accommodated within a back cavity defined by the back cavity structure 104; and a feed network 106 provided on the back cavity structure 104 and coupled to the plurality of dipole antennas 102.

In this embodiment, the antenna 100 comprises a number of parts includes two antenna substrates 108 mounted and connected to a base 104B of the back cavity structure 104. The back cavity structure 104 is preferably formed by a circular base 104B and a cylindrical sidewall 104S which combine to define a back cavity of the antenna 100.

Preferably, the side wall 104S has a corrugated shape or profile, thereby defining a corrugated back cavity when combined with the base 104B. Referring to FIG. 1, the side wall 104S includes different heights at different positions around the circular base 104B. For example, the circular cavity may include a radius of R defined by the base 104B, height of $h_c$, and thickness of the side wall 104S may be $t_c$. The heights in other positions of the side wall 104S may be further defined by $h_c-h_{c1}$ or $h_c-h_{c2}$ with a width of $w_{c1}$ and $w_{c2}$ respectively. Based on these parameters, a non-uniform corrugation is introduced to the cavity side wall 104S to broaden the beamwidth. The performance enhancement of such corrugated back cavity will be further discussed later in the disclosure.

The dual-band antenna has a plurality of dipole antennas 102, preferably includes at least one dipole antenna 102 operating in the L1 band and at least one dipole antenna 102 operating in the L2 band, such that the antenna 100 may be used in a dual-band application. For example, the L1 band and the L2 band include a 1.575 Ghz wireless communication band and a 1.227 Ghz wireless communication band respectively, therefore is suitable for GPS applications as discussed earlier. Alternatively, other communication bands may be selected for other dual-band or multi-band applications.

In this example, the dipole antennas 102 are cross-dipole antennas 102 which include dipole arms provided on two antenna substrates 108 being mounted to the back cavity structure 104. Referring to FIG. 1, the two antenna substrates 108 intersects with each other and is substantially perpendicular to each other. The substrates 108 are further mounted on the base 104B of the back cavity structure 104, such that the two antenna substrates 108 and the base 104B of the back cavity structure 104 are orthogonally arranged. In addition, the substrates 108, as well as the dipole antennas 102 thereon, are at least partially accommodated within the corrugated back cavity defined by the back cavity structure 104.

Figure 2:
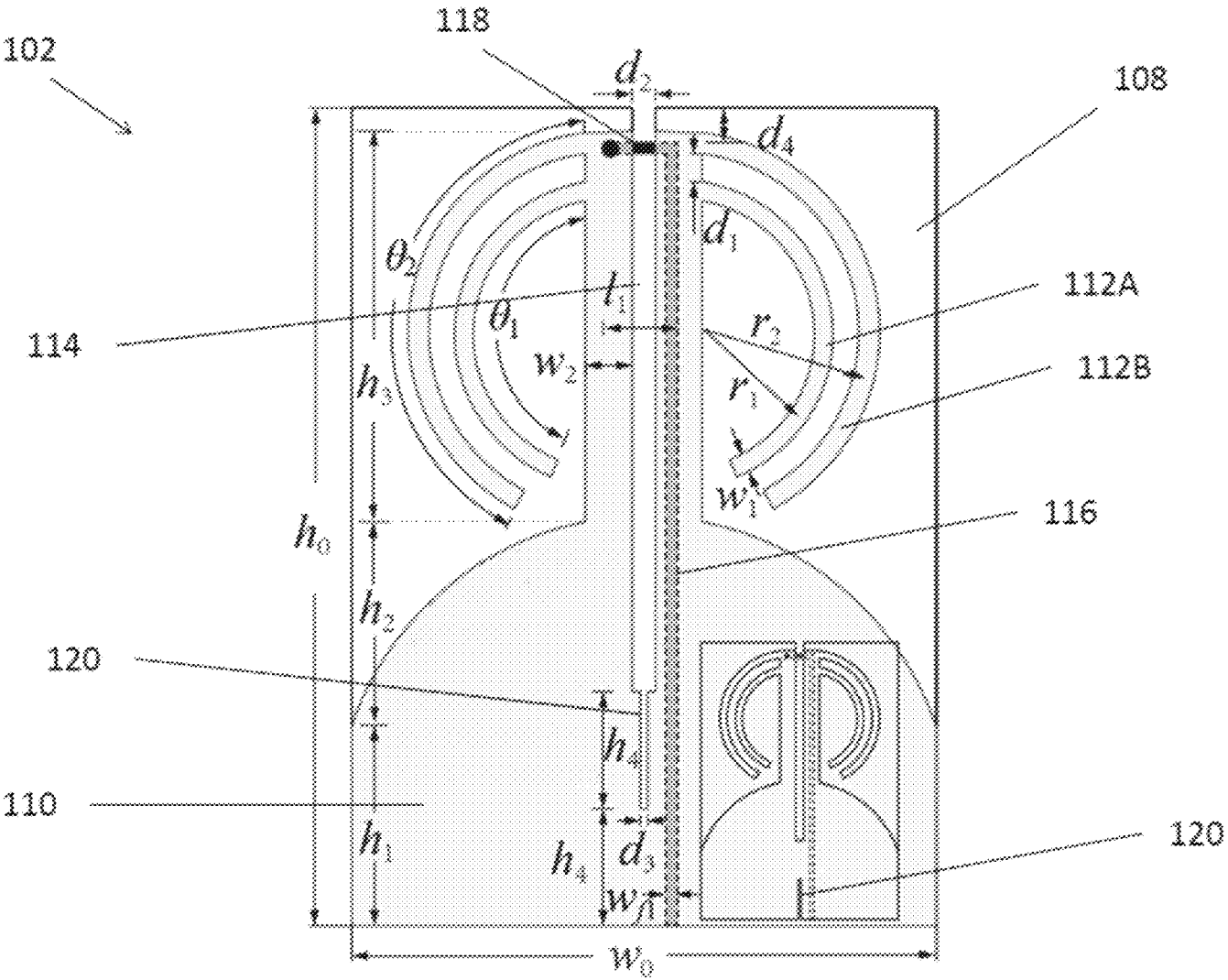
FIG. 2 is an illustration of an antenna substrate of the dual-band antenna of FIG. 1.

With reference also to FIG. 2, each of the antenna substrates 108 is defined with a plurality of dipole antennas 102 which may be cross-dipole antennas 102 in this preferable embodiment. Preferably, the antenna substrate 108 may be of a dielectric material as appreciated by a skilled person in the art, and the cross-dipole antennas 102 may be patters of metal layer, such as copper, defined on one or both surfaces of the substrate.

In this example, the substrate 108 is provided with a ground plane 110 in electrical connection with two sets of dipole arms 112 on a first side of the substrate 108. Preferably, each set of dipole arms 112 including at least one first dipole arm 112A and at least one second dipole arm 112B each having a different dimension. For example, each of the dipole arms 112 includes a curved structure defined with different subtended angles and radii so as to operate in the different bands, i.e. L1 and L2 band for GPS applications.

Referring to FIG. 2, the cross-dipole has unequal curved arms 112, and each arm has a uniform width of $w_1$. For the smaller curved dipole arm 112A, its radius and subtended angle are denoted by $r_1$ and $\theta_1$, respectively, whereas the corresponding parameters of the larger dipole 112B are $r_2$ and $\theta_2$. The dipole arms 112 in each adjacent pair are separated by a uniform distance of $d_1$ along the curvature.

Preferably, the plurality of dipole arms 112 couple to a slot feeder defined on the antenna substrate 108. In this example, an elongated slot 114 is defined between two sets of dipoles 112 with a width of $d_2$. A microstrip feedline 116 is further arranged on a second side, being opposite to the first side, of the substrate 108, such that the dipole 112 on the first side may receive excitations via the microstrip feedline 116 and the slot feeder. For example, a 50-Ω microstrip feedline may be obtained by including a short conductive tape 118 stuck across the slot 114 and connected to a printed conductive line 116 on the back side of the substrate. Preferably, in response to the excitations, the dipole antennas 102 communicate an electromagnetic signal with circular polarization.

In addition, the at least one antenna substrate 108 is provided with a joining structure, such as a slit 120 with a length of $h_4$ and a width of $d_3$, arranged to cooperate with another joining structure in another antenna substrate. Referring to FIG. 2, one of the substrate has a slit 120 formed adjacent to the elongated slot structure 114 and the other one (as shown in the inset) has the same slit 120 formed at the bottom edge of the substrate 108, such that when two substrates intersects with each other in a substantially perpendicular configuration, and mutually locking each other in such configuration when the substrates 108 are further mounted on the back cavity structure 104.

In one preferred embodiment, each substrate 108 has a size of $h_0 \times w_0$, dielectric constant of $\varepsilon_r$, thickness of t, and a slit 120 for the perpendicular insertion of the other substrate. After the mutual insertion of the two substrates 108, a short adhesive conducting tape 118 of length $l_1$ is stuck across the slot 114, connecting the microstrip feedline 116 to the dipole ground 110 through a via, which then forms a merchant balun to obtain a differential feed for the dipole.

The inset shows the other substrate. Basically, the layout is the substantially the same as that of the first substrate, but the narrow slit 120 is fabricated at the bottom. Also, the horizontal conducting strip 118 may be slightly shifted upwards (or downwards) to avoid shorting that of the first substrate.

Figure 3B:
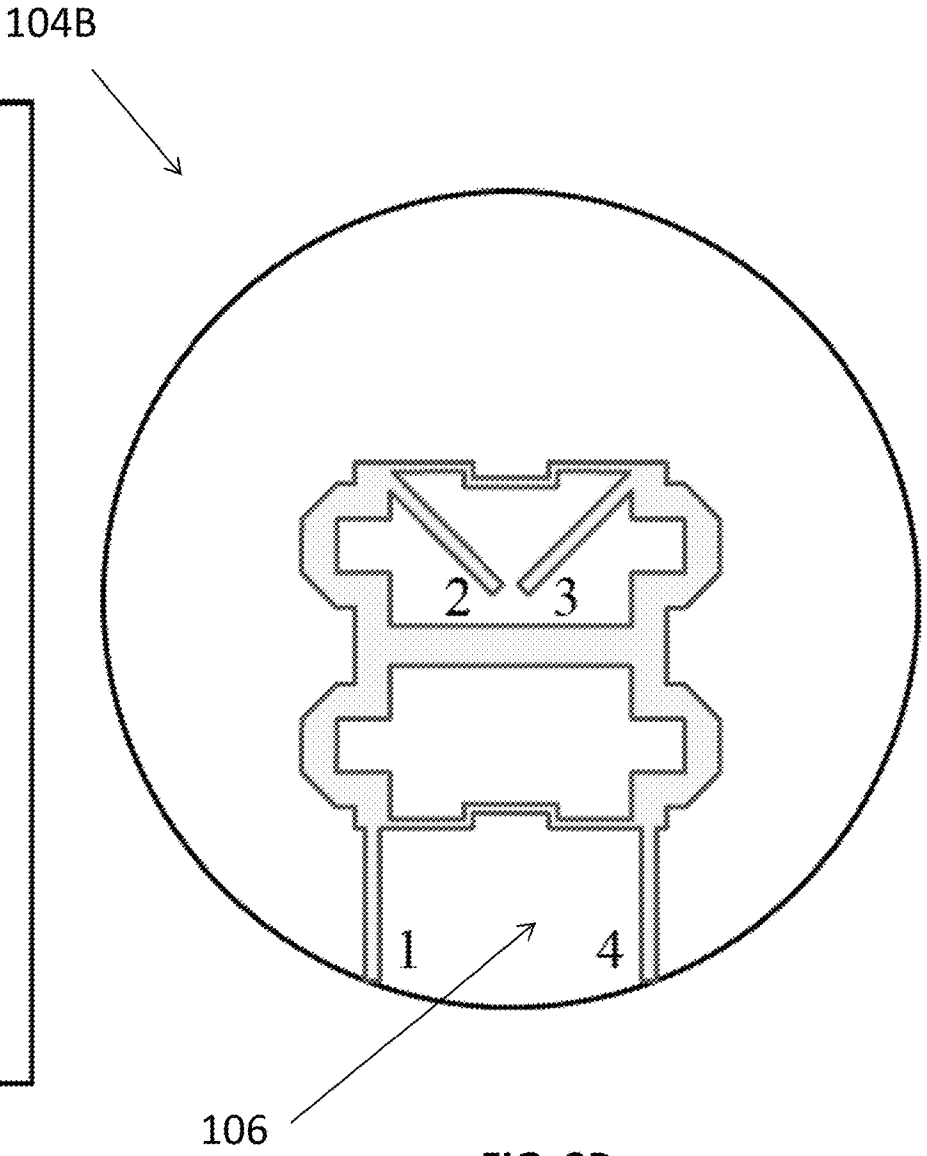
FIG. 3B is an illustration of a feed network with a folded structure modified based on the feed network of FIG. 3A.
Figure 3A:
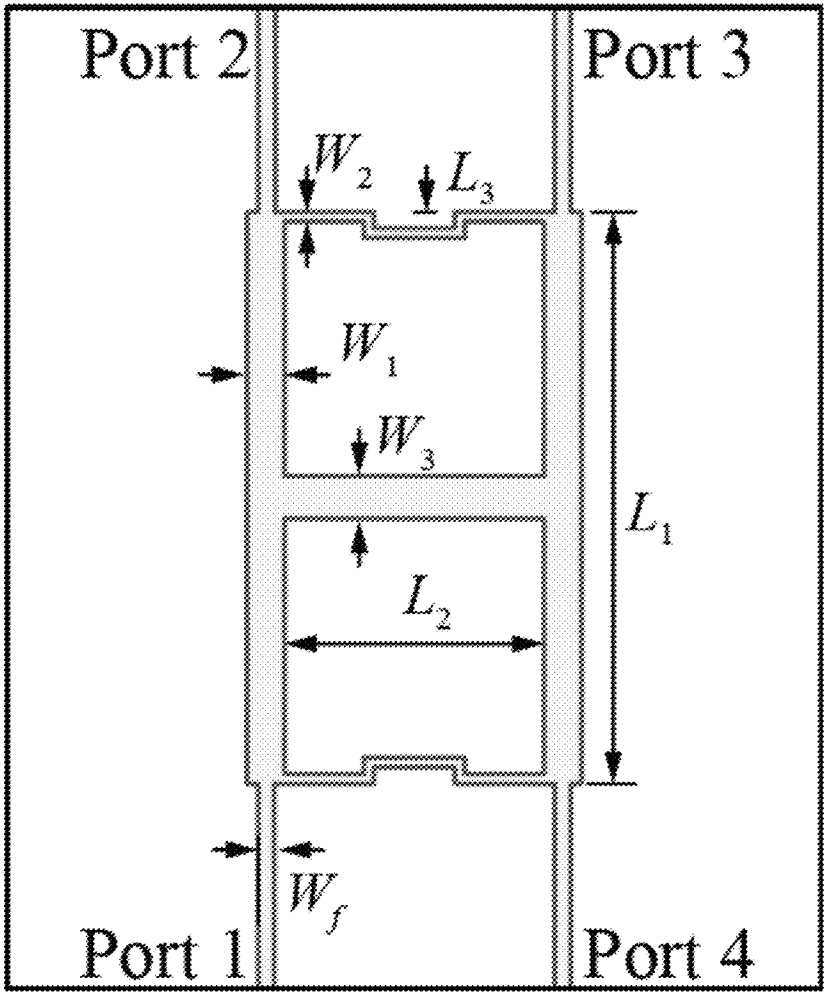
FIG. 3A is an illustration of a feed network for use in an antenna.
Figure 4A:
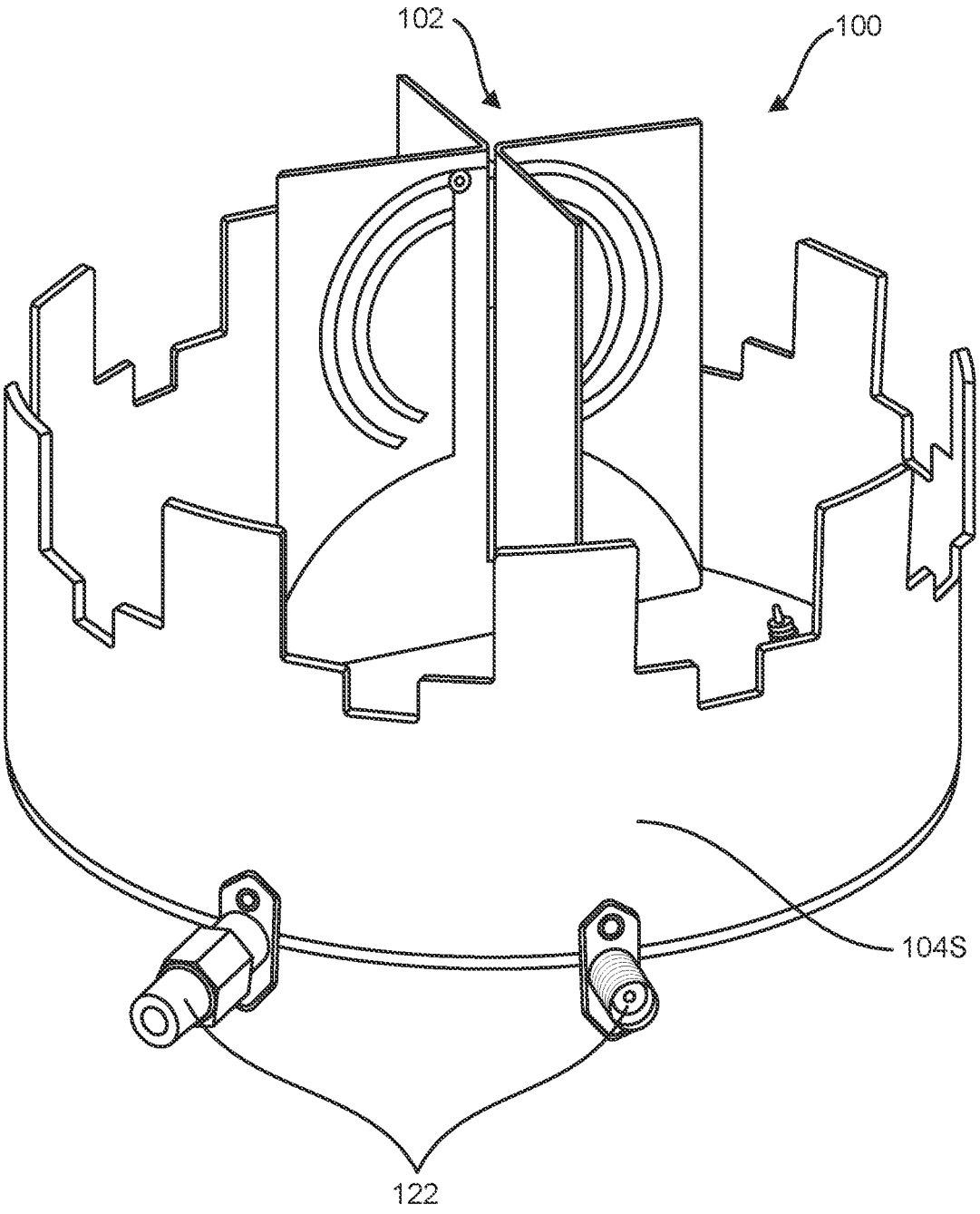
FIGS. 4A and 4B are photographic images showing top and bottom perspective view of the antenna of FIG. 1.
Figure 4B:
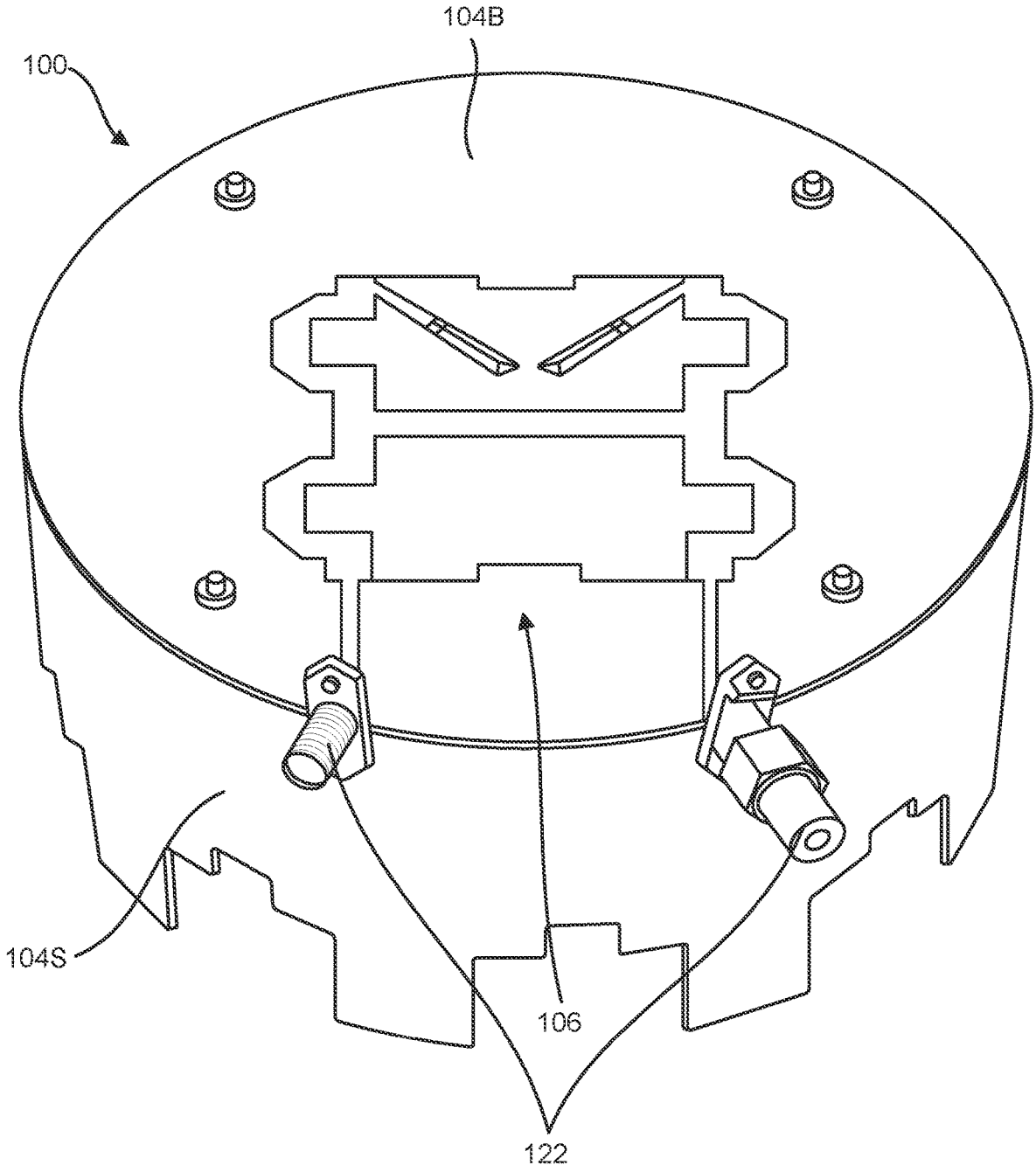

With reference to FIGS. 3A and 3B, the feed network 106 includes a two-stage cascaded hybrid coupler. In GPS applications, L1 band (1.227 GHz) is nearby L2 band (1.575 GHz). Since the frequency ratio of these two bands is small, it may only require very narrow coupled lines for a dual-band hybrid coupler. Preferably, the feed network 106 may include a two-stage cascaded hybrid coupler.

Referring to FIG. 3A, there is shown an example two-stage hybrid coupler, with all the four ports defined near the edges of the feed network 106. It may be more preferable that two of the ports are placed near the center of the feed network 106, such that the feed network 106 may be provided on the base 104B of the back cavity structure 104.

Referring to FIG. 3B, there is shown an example embodiment of a "folded" version of the two-stage hybrid coupler. The feed network 106 is defied with a first set of ports (ports 2 and 3) coupled to the plurality of dipole antennas 102 and a second set of ports (ports 1 and 4) coupled to external connectors mounted on the back cavity structure 104. Preferably, ports 2 and 3 may be defined on a base 104B of the back cavity structure 104 proximate to a center position of the base 104B, and ports 1 and 4 are defined proximate to an edge position of the base 104B.

The base 104B of the back cavity structure 104 may be a feed substrate which has a dielectric constant of $\varepsilon_{r1}$ and thickness of $t_1$. Its radius is substantially the same as that of the back cavity or the cylindrical side wall 104S. The feed network 106 is provided on a bottom surface of a base 104B of the back cavity structure 104. Preferably, the feed network 106 is defined with a folded side length between a proximate pair of ports in one of the first set of ports and one of the second set of ports. For example, the length $L_1$ between ports 1 and 2 (or ports 4 and 3) is substantially "folded", with ports 2 and 3 placed near the center of the base 104B. The ports 2 and 3 may be further connected to the microstrip feedline 116 on the dipole antennas 102 mounted on top of the base 104B.

In addition, the feed network 106 is coupled to the plurality of dipole antennas 102 provided on an opposite (top) surface of the base 104B through a plurality of via structures. For example, the vias may allow electrical connectors such as wires or metal leads to pass through such that features on both sides of the feed substrate or the base 104B may be electrically connected.

In some example embodiments, the antenna 100 may include a different number of antenna substrates 108 and/or dipole arms formed on the substrates 108. Alternatively, the antenna 100 may be included in an antenna assembly which comprising a plurality of dual-band antenna 100 arranged in an array.

With reference to FIGS. 4A to 4F, there is shown an antenna fabricated in accordance with an embodiment of the present invention. In this embodiment, the dual-band CP antenna that consists of a cross-dipole 112 printed on two perpendicular substrates 108, a circular aluminum back cavity 104, and a feed network 106 with a cascaded hybrid coupler. The cross dipoles 112 are placed (partially) inside the cavity, and beneath the cavity 104 is the feed network 106. A via passing through the cavity 104 is used to connect the cross-dipole 112 to the feed network 106. In addition, two connectors 122 (e.g. SMA connectors) are mounted at an edge of the base 104B and connect to ports 1 and 4 of the feed network 106, with ports 2 and 3 connecting to the antennas on the other side of the base 104B through the vias by soldering.

In this embodiment, the dual-band antenna 100 has the following parameters: R=53.75 mm, $h_c$=45 mm, $h_{c1}$=14.5 mm, $h_{c2}$=19.5 mm, $w_{c1}$=7.5 mm, $w_{c2}$=7.5 mm, $t_c$=1.5 mm, $\varepsilon_r$=6.15, $\varepsilon_{r1}$=2.94, t=0.635 mm, $t_1$=0.76 mm, $h_0$=70 mm, $h_1$=17.14 mm, $h_2$=17.38 mm, $h_3$=33.48 mm, $h_4$=10 mm, $d_1$=2.42 mm, $d_2$=2 mm, $d_3$=0.635 mm, $d_4$=3 mm, $r_1$=12.4 mm, $r_2$=16.3 mm, $\theta_1$=158 deg, $\theta_2$=152 deg, $w_0$=50 mm, $w_1$=1.8 mm, $W_1$=4.62 mm, $W_2$=0.45 mm, $W_3$=5.25 mm, $l_1$=6.94 mm, $L_1$=70 mm, $L_2$=31.88 mm, $L_3$=2 mm, $W_f$=1.92 mm, and $W_{f1}$=0.92 mm. The performance of the fabricated antenna has been measured as well as evaluated using ANSYS HFSS simulation, in particular in the L1 and L2 bands. It was observed that there is reasonable agreement between the measured and simulated results.

To begin with, the wideband cascaded hybrid coupler was designed to cover the two bands. Table I lists its simulated phase difference and amplitude imbalance between the two output ports, along with the S-parameters of the four ports. The overlapping bandwidth is 44.0% (1.10-1.72 GHz), which is sufficient for GPS L1 and L2 bands. The antenna was fabricated and measured to verify the simulations.

TABLE I

SIMULATED PERFORMANCE OF WIDEBAND FEED NETWORK

| | |
|---|---|
| 10-dB Impedance bandwidth | 1.08-1.82 GHZ (51.0%) |
| 90° ± 5° Phase difference | 1.00-1.86 GHZ (60.1%) |
| 1.5-dB amplitude imbalance | 1.10-1.72 GHZ (44.0%) |
| Overlapping bandwidth | 1.10-1.72 GHZ (44.0%) |

In the measurement experiments for evaluating the performance of the antenna, the voltage standing wave ratio (VSWR) was measured with the Keysight VNA 8361A, whereas the AR, radiation pattern, realized antenna gain, and total antenna efficiency were measured with a Satimo Star-Lab System. Since the antenna in this example was designed for GPS applications, only the results of the right-handed CP (RHCP) port (Port 1) are presented here.

Figure 5:
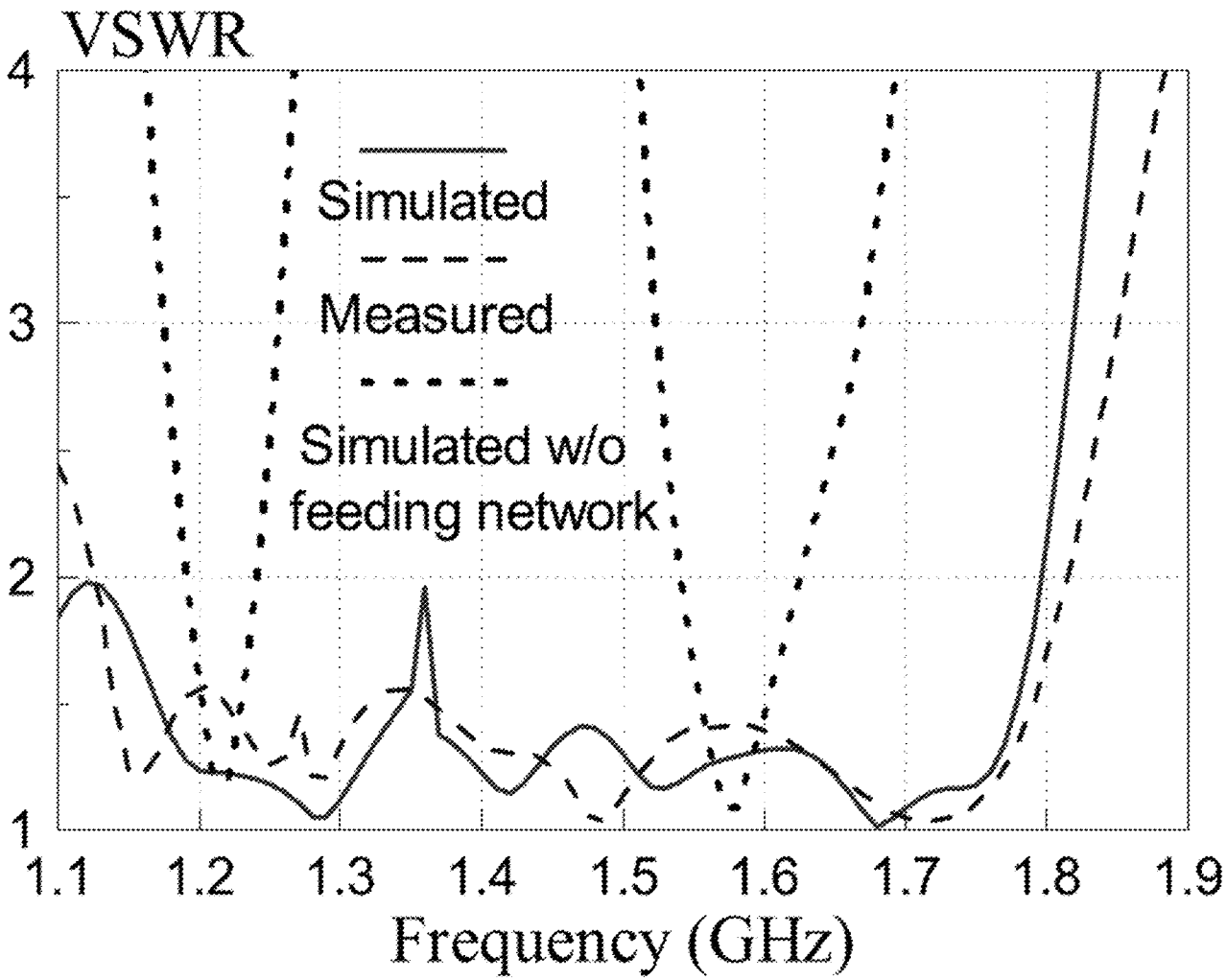
FIG. 5 is a plot showing measured and simulated VSWRs of the dual-band CP antenna.

With reference to FIG. 5, there is shown the measured and simulated VSWRs of the antenna, with reasonable agreement between them. With reference to the plot, the measured and simulated impedance bandwidths (VSWR≤2) are 46.3% (1.13-1.81 GHz) and 47.8% (1.10-1.79 GHz), respectively. The plot also shows the simulated VSWR without the feed network. With reference to the figure, two frequency bands corresponding to L1 and L2 bands are found, showing that the wideband matching of the full structure is due to the feed network.

With reference to FIGS. 6A to 6D, there is shown the simulated current of the cross-dipole. The currents mainly flow along the outer and inner dipole arms at 1.227 GHz (L2 band) and 1.575 GHz (L1 band), respectively, which can be expected.

Figures 6A, 6B, 6C, 6D:
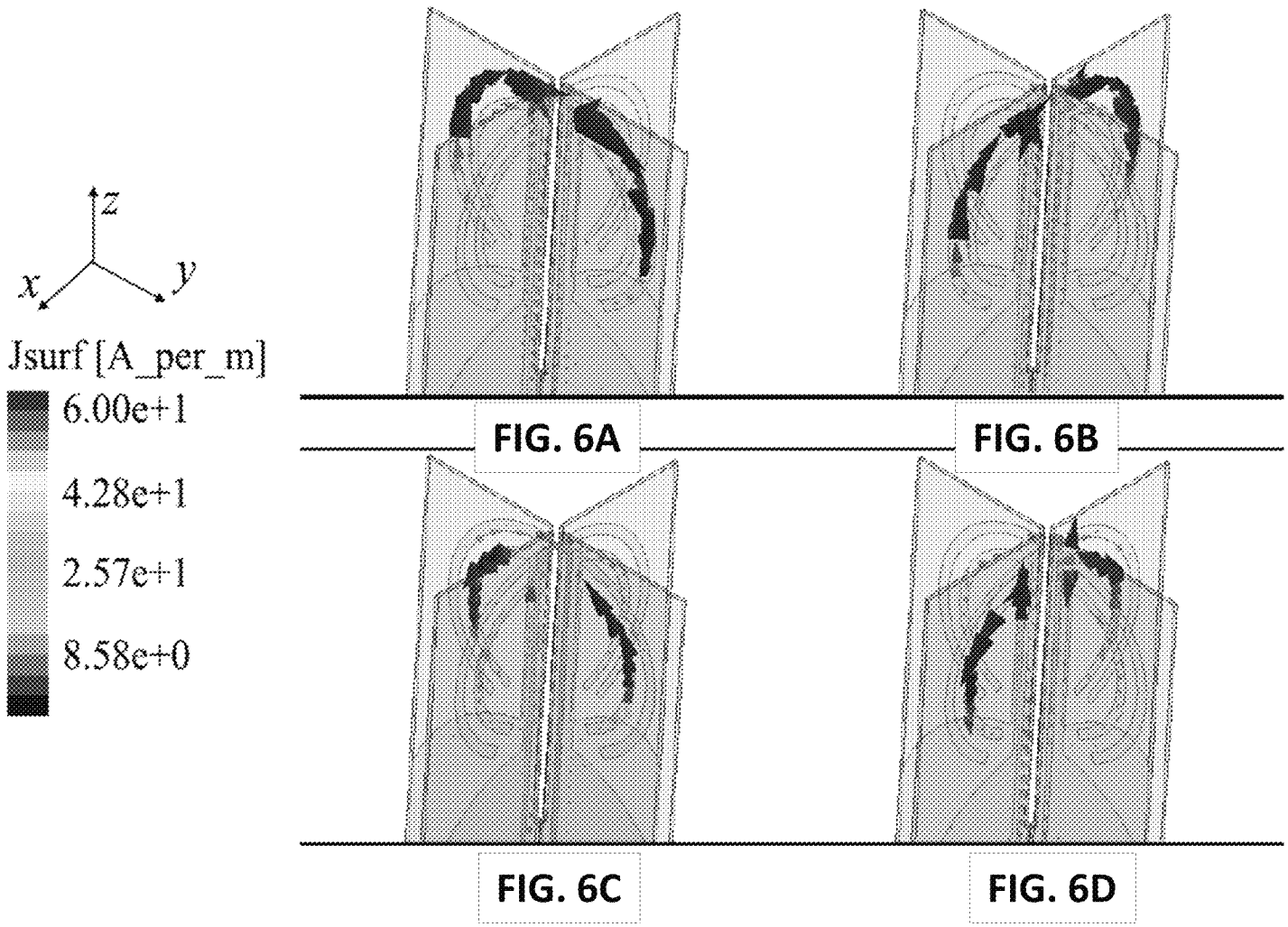
FIGS. 6A to 6D are color plots showing simulated current distribution of the dual-band CP antenna in L2 band (1.227 GHz) at t=0; in L2 band at t=T/4; in L1 band (1.575 GHz) at t=0; and in L1 band at t=T/4, respectively.

With reference to FIG. 6A, the dipole currents at t=0 mainly flow along the +y direction in the yoz-plane, radiating the +y-directed E-field. In this case, the currents on all the other dipole arms are very weak. At t=T/4 as shown in FIG. 6B, the currents mainly flow on the other pair of the outer arms in the □x direction (xoz-plane). Therefore, the □x-directed E-field is radiated. As a result, RHCP fields can be generated at 1.227 GHz. Similar current variations at 1.575 GHz (L1 band) can also be observed referring to FIGS. 6C and 6D respectively.

Figure 7:
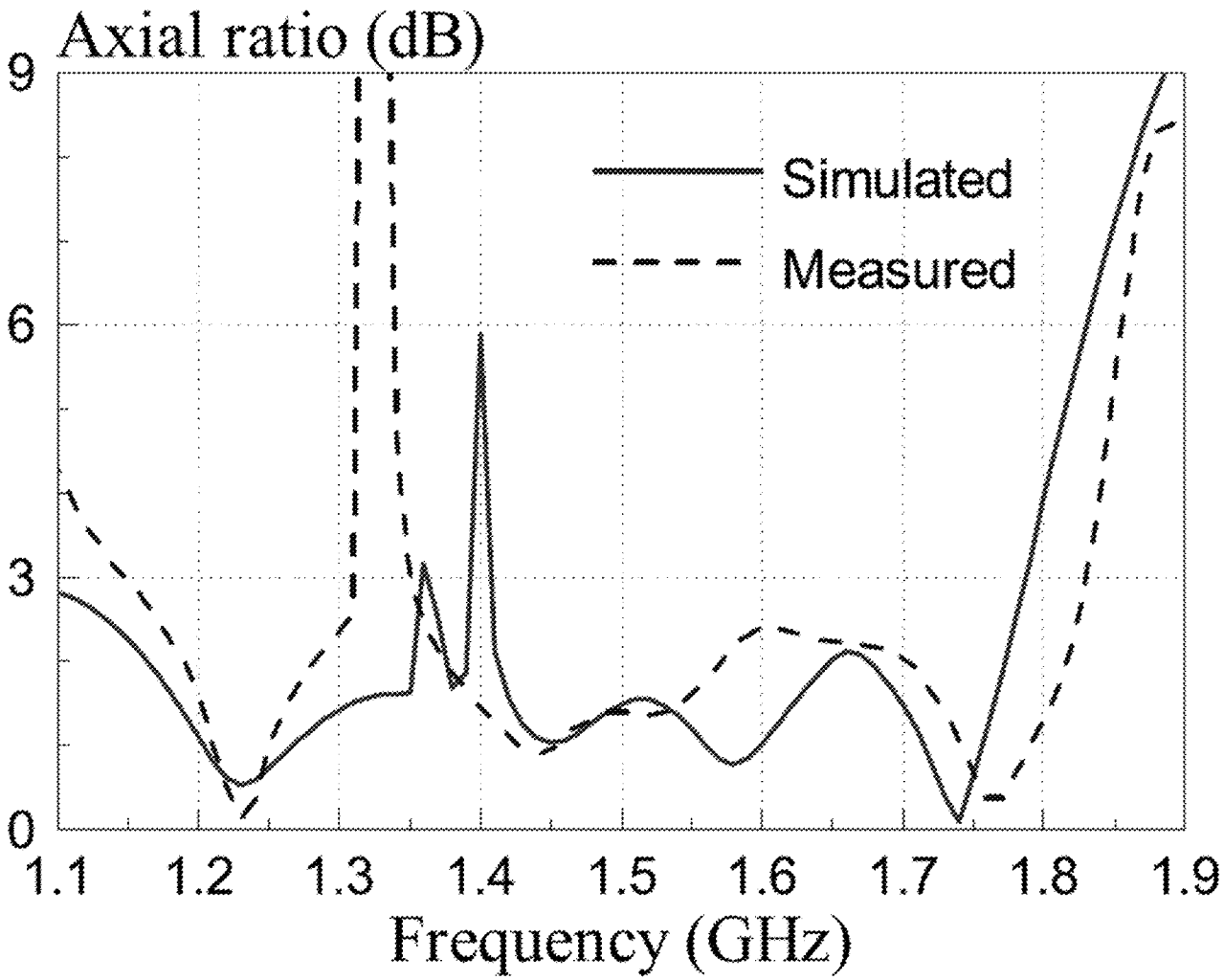
FIG. 7 is a plot showing measured and simulated ARs of the dual-band CP antenna in boresight direction (θ=0°)

With reference to FIG. 7, there is shown the measured and simulated ARs in the boresight direction (0=0°). The measured and simulated 3-dB AR bandwidths of L2 band are 13.0% (1.15-1.31 GHz) and 20.4% (1.10-1.35 GHz), respectively. For L1 band, the measured and simulated AR bandwidths are given by 30.2% (1.35-1.83 GHz) and 23.2% (1.41-1.78 GHz), respectively. Both the measured and simulated VSWR and AR bandwidths entirely cover L1 and L2 bands.

Figure 8A:
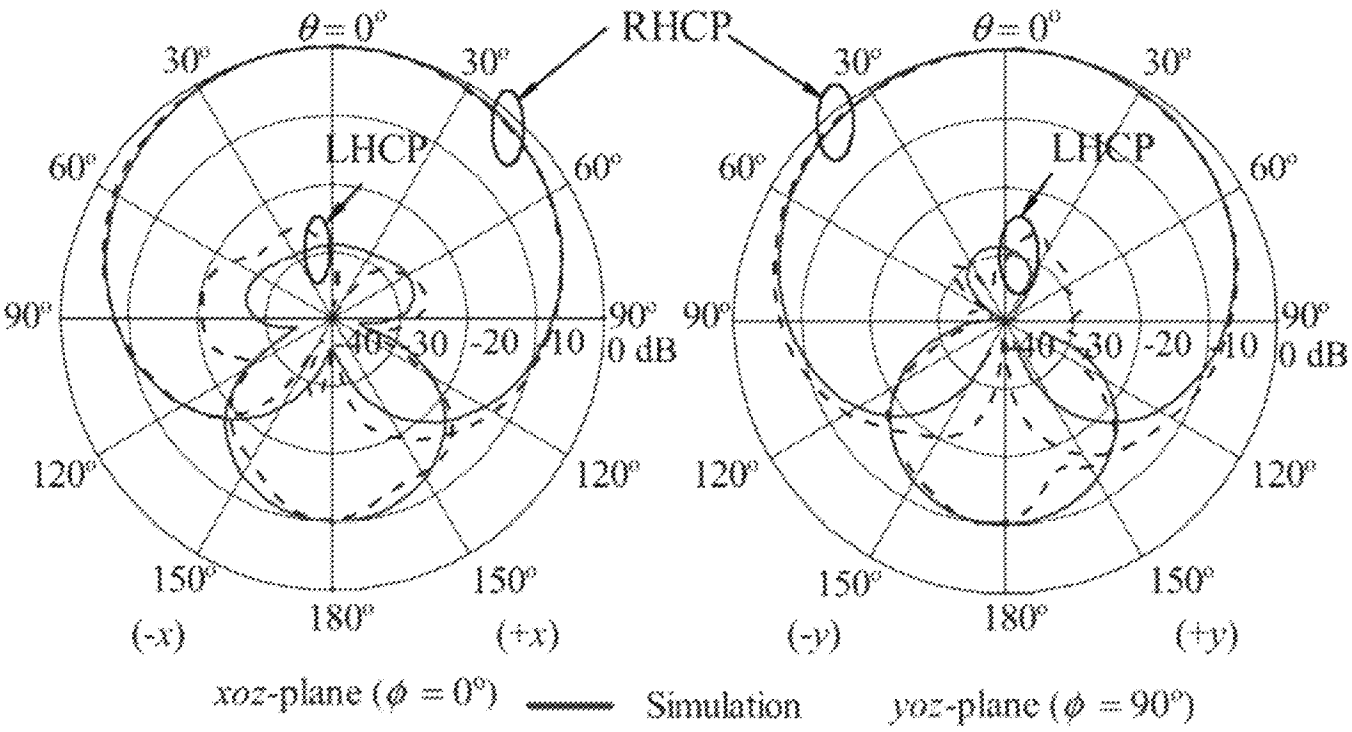
FIGS. 8A and 8B are plots showing measured and simulated radiation patterns of the dual-band CP antenna in xoz (ϕ=0°) and yoz planes (ϕ=90°) in L2 band (1.227 GHz) and in L1 band (1.575 GHz), respectively.
Figure 8B:
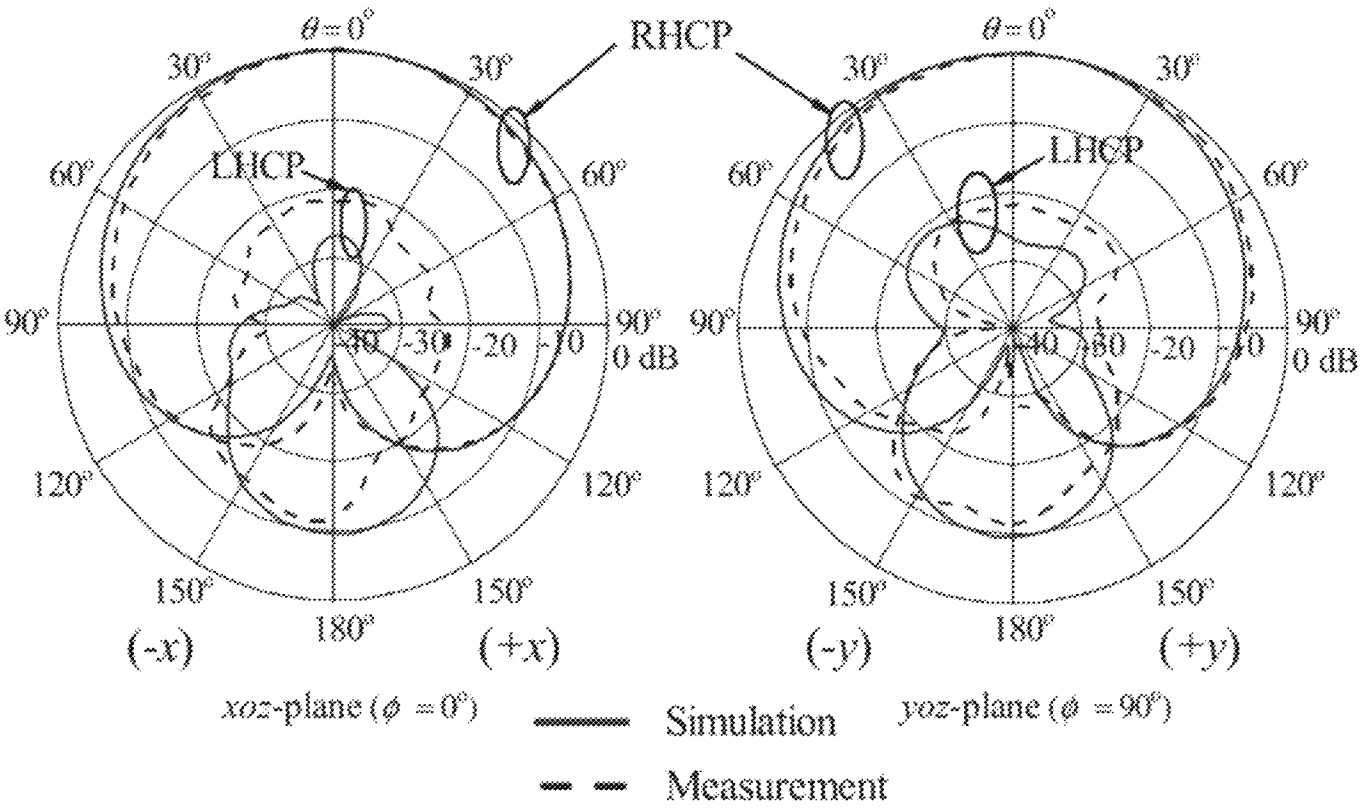

With reference to FIG. 8, there is shown the measured and simulated radiation patterns of the dual-band CP antenna. For the entire upper hemisphere, the measured L2- and L1-band cross-polar fields are about 30 dB and 20 dB weaker than their co-polar counterparts, respectively, leading to very wide 3-dB AR beamwidths. The measured xoz- and yoz-plane half-power beamwidths (HPBWs) of L2 band are as wide as 111° and 114°, respectively. For the L1 band, the xoz- and yoz-plane HPBWs are 103° and 109°, respectively.

Figure 9A:
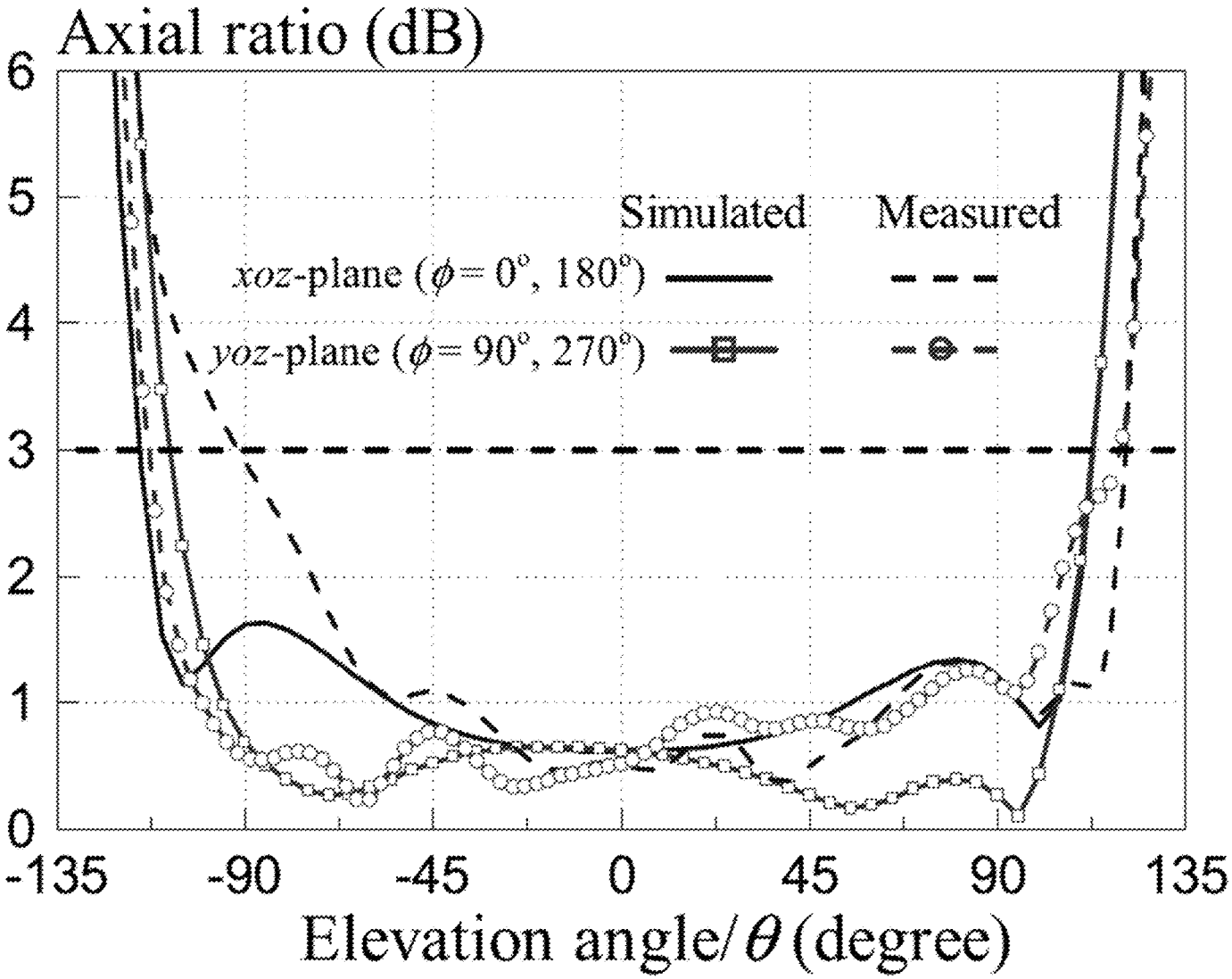
FIGS. 9A and 9B are plots showing measured and simulated AR beamwidths of the dual-band CP antenna in xoz (ϕ=0°) and yoz (ϕ=90°) planes in L2 band (1.227 GHz) and in L1 band (1.575 GHz), respectively.
Figure 9B:
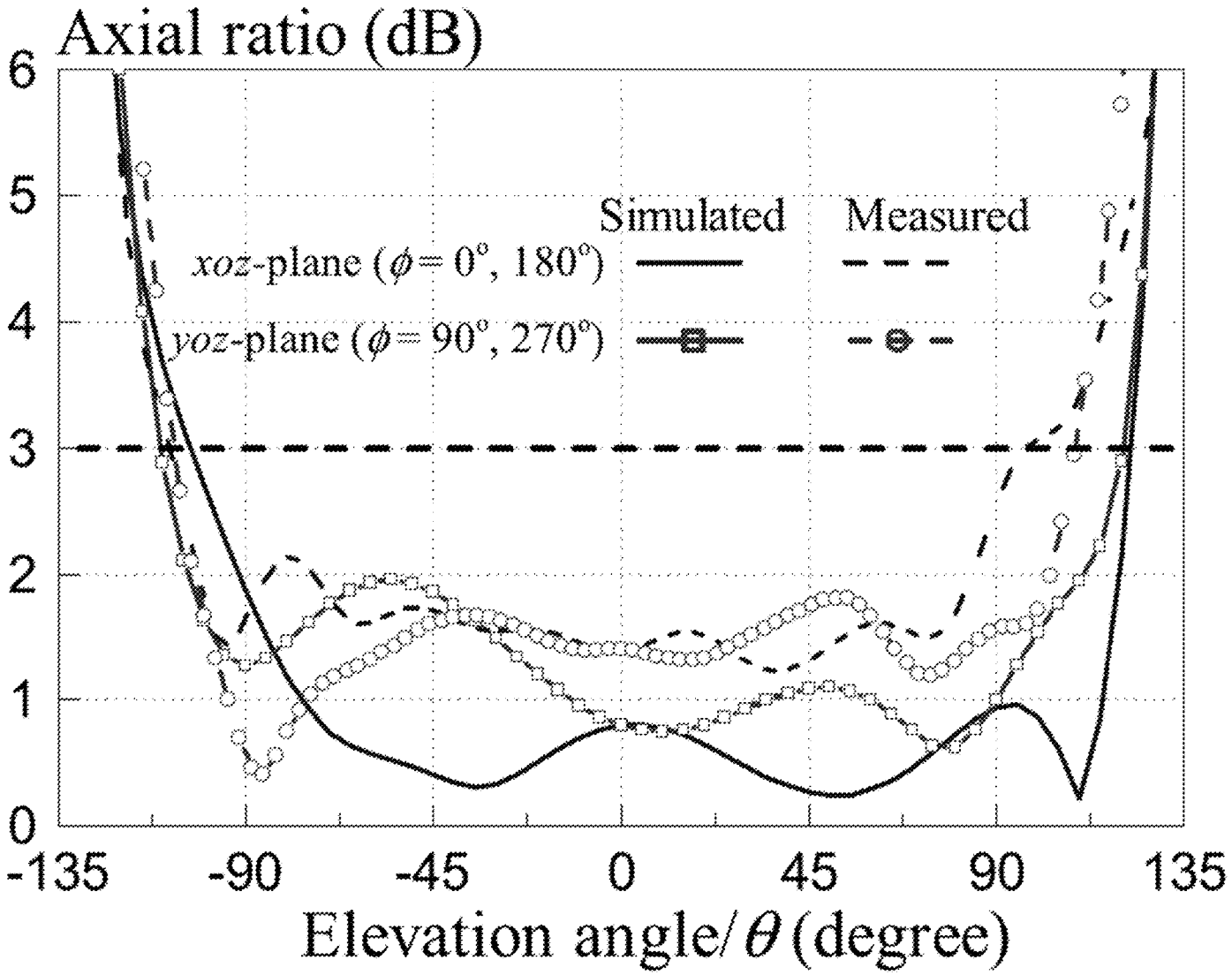

With reference to FIGS. 9A and 9B, there is shown the measured and simulated AR beamwidths of the antenna, with acceptable agreement between the measurement and simulation. With reference to FIG. 9A, very wide measured L2-band 3-dB AR beamwidths of 211° and 228° are obtained in the xoz- and yoz-planes, respectively. For the L1 band as shown in FIG. 9B, the measured 3-dB AR beamwidths in the xoz- and yoz-planes are 202° and 213°, respectively. Both the measured and simulated results can fully cover the upper hemisphere.

Figure 10:
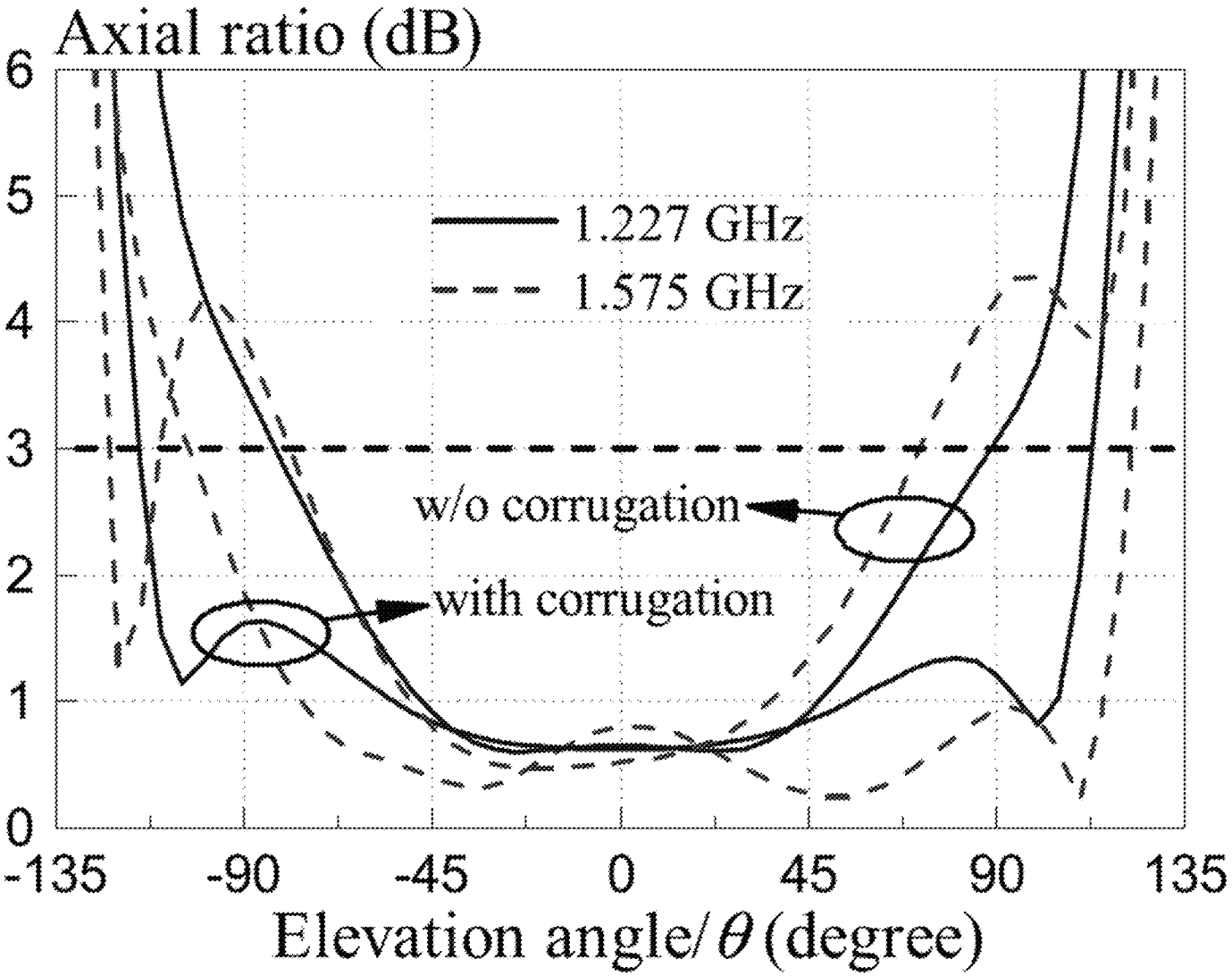
FIG. 10 is a plot showing simulated AR beamwidths of the cavity-backed dual-band CP antennas with and without the corrugation at 1.227 GHz and 1.575 GHz in xoz (ϕ=0°) plane.

To study the effect of the corrugation, the AR beamwidths of two cavity-backed dual-band CP antennas with and without the corrugation were simulated. With reference to FIG. 10, there is shown the simulated AR beamwidths of two cavity-backed dual-band CP antennas with and without the corrugation. For brevity, the plots only shows the results in the xoz-(ϕ=0°) plane only. AS shown in the Figure, when there are no corrugations, the AR beamwidths of the antenna are 171° and 151° at 1.227 GHz and 1.575 GHz, respectively. By inserting the corrugation, they are broadened to the respective values of 228° and 225°, fully covering the upper hemisphere.

It may be observed that for a given corrugation depth, the AR beamwidth is affected over a narrow frequency range only. To broaden the AR beamwidth for both frequency bands, a non-uniform corrugation with different depths is therefore deployed in a preferred embodiment.

Figure 11:
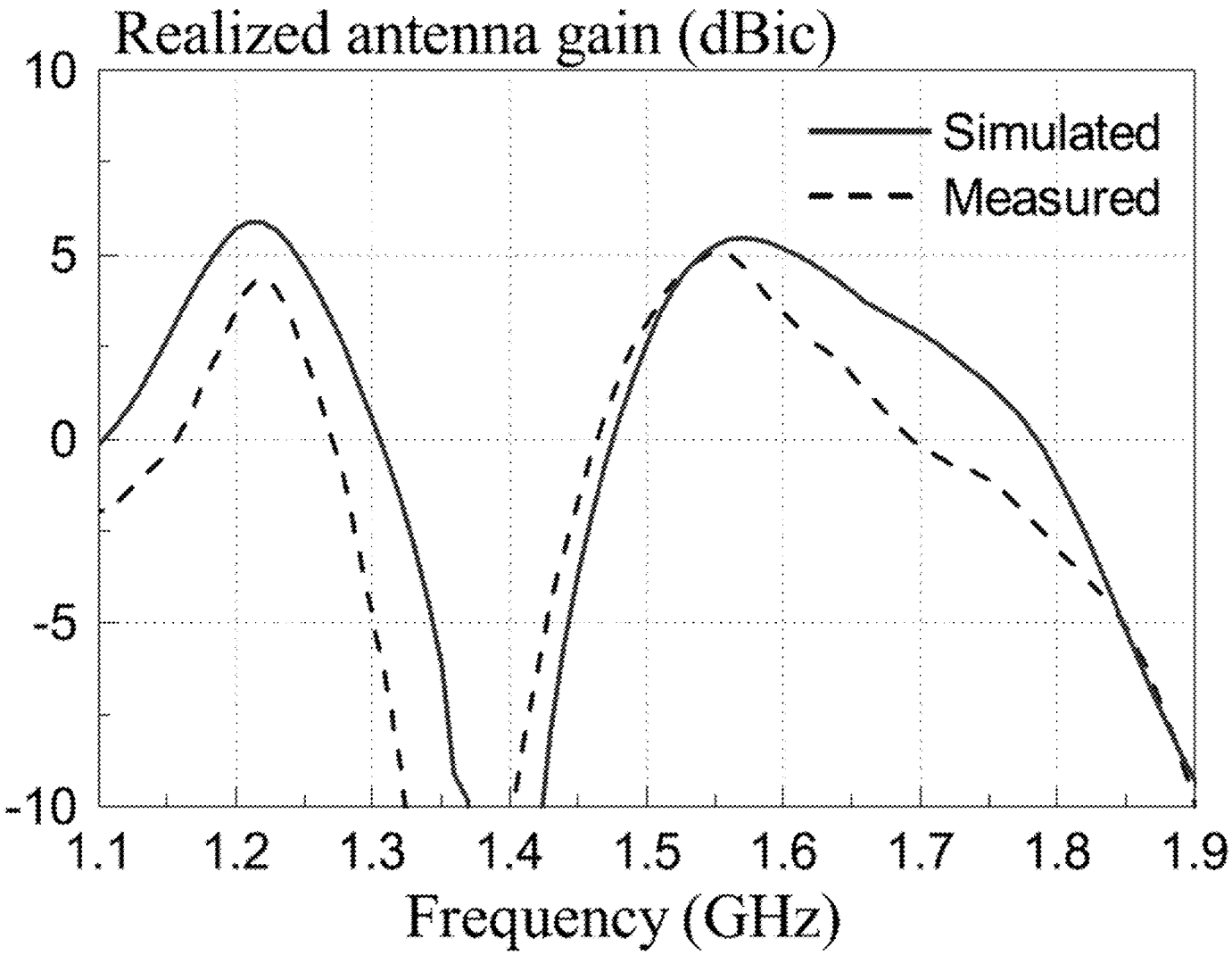
FIG. 11 is a plot showing measured and simulated antenna gains of the dual-band CP antenna in boresight direction (θ=0°)

With reference to FIG. 11, there is shown the measured and simulated realized antenna gains (mismatch included) in the boresight direction (θ=0°). Again, the measured and simulated results are in reasonable agreement. With reference to the figure, both the measured and simulated results show two peaks at around 1.227 GHz (L2 band) and 1.575 GHz (L1 band). At 1.227 GHz, the measured and simulated peak values are 4.39 dBic and 5.88 dBic, respectively. The discrepancy may be because of imperfections in the experiment. Similar measured and simulated gains of 5.06 dBic and 5.45 dBic are obtained at 1.575 GHz (L1 band).

Figure 12:
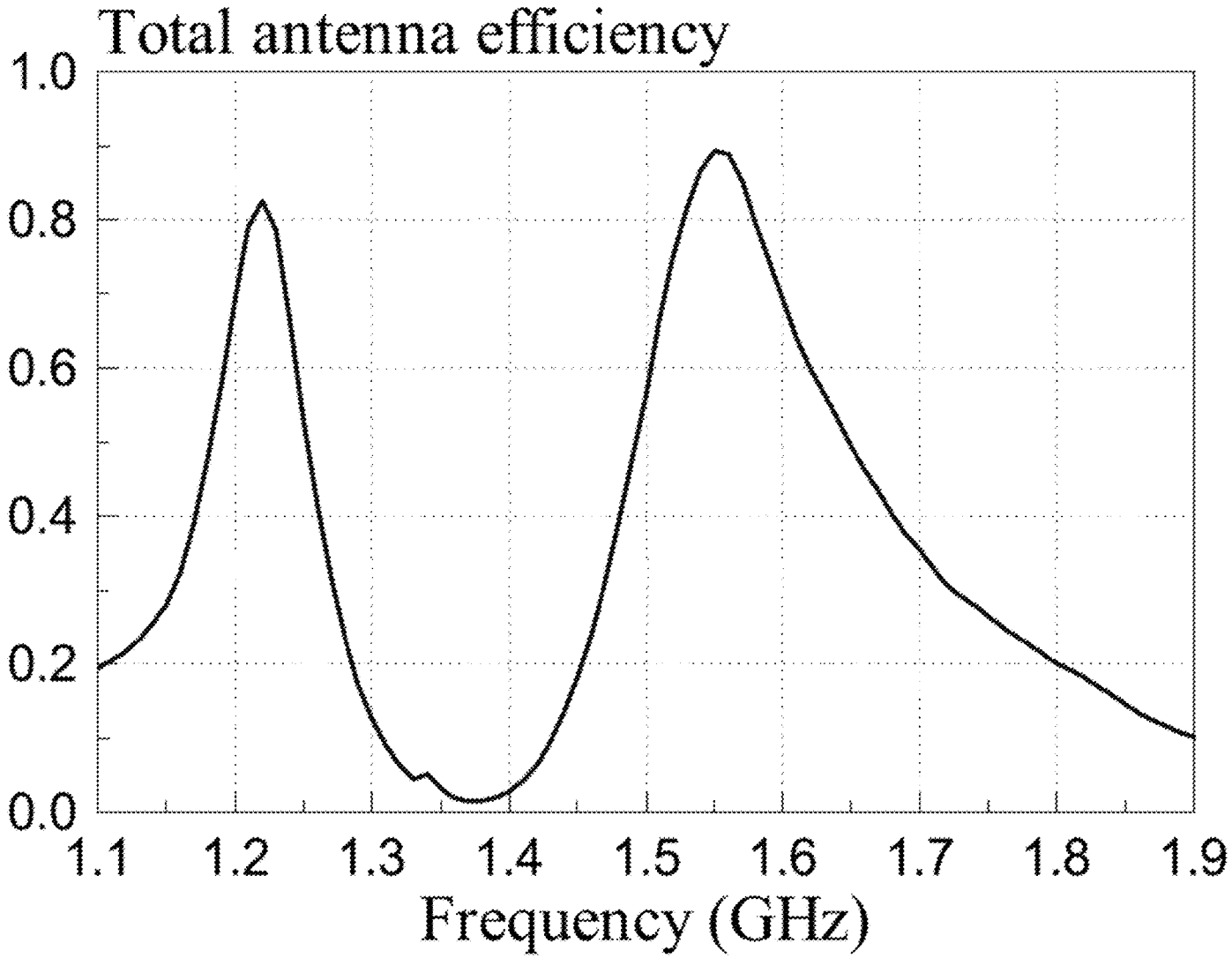
FIG. 12 is a plot showing measured antenna efficiency of the dual-band CP antenna.

With reference to FIG. 12, there is shown the measured total antenna efficiency (mismatch included). As can be observed from the figure, the efficiency also exhibits two peaks in L1 and L2 bands, as expected. Its peak values are 82.6% and 89.3% at 1.220 and 1.550 GHz, respectively, which are very close to the L2- and L1-band frequencies.

Table II below illustrates a summary of the performance of the dual-band CP antennas in accordance with embodiment of the present invention. Advantageously, the antenna is found to be having wide AR beamwidths that can cover the upper hemisphere for both frequency bands. Therefore, the antenna may be used in GPS ground terminals, vehicles, and ships.

TABLE II

MEASURED PERFORMANCE OF THE DUAL-BAND CP ANTENNA

| Measured results | L2 Band (1.227 GHz) | L1 Band (1.575 GHz) |
|---|---|---|
| Impedance bandwidth | (46.3%) 1.13-1.81 GHz | |

TABLE II-continued

| MEASURED PERFORMANCE OF THE DUAL-BAND CP ANTENNA | | | |
|---|---|---|---|
| Measured results | | L2 Band (1.227 GHz) | L1 Band (1.575 GHz) |
| 3-dB AR bandwidth | | 13.0% (1.15-1.31 GHz) | 30.2% (1.35-1.83 GHz) |
| Peak antenna gain | | 4.39 dBic @1.22 GHz | 5.06 dBic @1.55 GHz |
| HPBW | xoz | 111° | 103° |
| | yoz | 114° | 109° |
| 3-dB AR | xoz | 211° (−91°, 120°) | 202° (−105°, 97°) |
| beamwidth | yoz | 228° (−111°, 117°) | 213° (−105°, 108°) |
| Antenna efficiency | | 82.6% | 89.3% |

These embodiments may be advantageous in that, the impedance and AR passbands of the dual-band antenna are sufficient for the two bands. It has been also found that the L1- and L2-band AR beamwidths are both over 200° in the two principal radiation planes, covering the entire upper hemisphere. Thus, the dual-band CP cross-dipole antenna is suitable for GPS L1- and L2-band applications.

Advantageously, the two sets of curved dipoles have been designed to obtain the dual-band operation. Such design with the shorter and longer arms may facilitate the communication of signals in for L1 and L2 bands, respectively. Apart from using curve dipole arms, a non-uniform corrugated cavity has been deployed to broaden the beamwidth.

In addition, the antenna of the present invention outperforms when comparing with some example antennas. For example, with reference to Table 3 below, although the HPBW in example 1 antenna is wider than that of the present invention, its peak gain (<1 dBic) and AR beamwidth (~100°) of example 1 are much smaller than those of the present invention (peak gain>4 dBic; AR beamwidth>200°) for both frequency bands. Example 1 antenna also has a higher profile despite its footprint is smaller. Also, it vertically puts two individual quadrifilar helix antennas together to obtain the two frequency bands, requiring two feeding ports. On the other hand, for the design in Example 2 antenna, a very low profile and relatively higher peak gains can be obtained, but both its HPBW and AR beamwidth are much narrower than those of the present invention.

TABLE III

| Performances of other example dual-band CP antennas | | | | |
|---|---|---|---|---|
| Antenna | Example 1 | | Example 2 | |
| Structure | Combine two quadrifilar helix antennas together | | Single planar cross dipole on AMC surface | |
| Overall size ($\lambda_0$) | $0.140\lambda_0 \times 0.140\lambda_0 \times 0.387\lambda_0$ @1.615 GHz | | $0.576\lambda_0 \times 0.576\lambda_0 \times 0.088\lambda_0$ @2.4 GHz | |
| Operating frequencies (GHz) | 1.615 | 2.492 | 2.4 | 5.2 |
| Impedance bandwidth | 28% | 39% | 16.7% | 11.5% |
| AR bandwidth | Not available | Not available | 8.30% | 5.77% |
| Peak gain (dBic) | <1 | <1 | 5.1 | 6.2 |
| HPBW (Degree) | >180° | >180° | 60[e] | 82° |
| AR beamwidth (Degree) | ~100° | ~100° | <120° | <60° |

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A dual-band antenna for global positioning system, comprising:

a plurality of dipole antenna arranged to operate in a L1 band and a L2 band;

a back cavity structure mounted to the plurality of dipole antennas, wherein the plurality of dipole antennas are at least partially accommodated within a back cavity defined by the back cavity structure; and a feed network provided on the back cavity structure and coupled to the plurality of dipole antennas, wherein the feed network includes a two-stage cascaded hybrid coupler; wherein the feed network is defied with a first set of ports coupled to the plurality of dipole antennas and a second set of ports coupled to external connectors mounted on the back cavity structure, and wherein:

(i) the first set of ports are defined on a base of the back cavity structure proximate to a center position of the base, and the second set of ports are defined proximate to an edge position of the base; or (ii) the feed network is further defined with a folded side length between a proximate pair of ports in one of the first set of ports and one of the second set of ports.

2. The dual-band antenna in accordance with claim 1, wherein the plurality of dipole antennas includes a plurality of cross-dipole antennas.

3. The dual-band antenna in accordance with claim 2, wherein the plurality of cross-dipole antennas comprises a plurality of dipole arms including at least one first dipole arm and at least one second dipole arm, wherein the first dipole arm has a dimension different from that of the second dipole arm.

4. The dual-band antenna in accordance with claim 3, wherein each of the plurality of dipole arms includes a curved structure, wherein the first dipole arm and the second dipole arm are defined with two different subtended angles and radii so as to operate in the L1 band and the L2 band respectively.

5. The dual-band antenna in accordance with claim 4, wherein the plurality of cross-dipole antennas are provided on at least one antenna substrate mounted to the back cavity structure.

6. The dual-band antenna in accordance with claim 5, wherein each of the at least one antenna substrate is provided with the plurality of dipole arms defined on a first side of the respective antenna substrate.

7. The dual-band antenna in accordance with claim 6, wherein the plurality of dipole arms couple to a slot feeder defined on the respective antenna substrate.

8. The dual-band antenna in accordance with claim 6, comprising two antenna substrates intersecting with each other.

9. The dual-band antenna in accordance with claim 8, wherein the two antenna substrates and a base of the back cavity structure are orthogonally arranged.

10. The dual-band antenna in accordance with claim 6, wherein each of the at least one antenna substrate is provided with a joining structure arranged to cooperate with another joining structure in another antenna substrate.

11. The dual-band antenna in accordance with claim 10, wherein the joining structure includes a slit formed on the each of the at least one antenna substrate.

12. The dual-band antenna in accordance with claim 6, wherein each of the at least one antenna substrate is provided with a ground plane on the first side of the substrate.

13. The dual-band antenna in accordance with claim 12, wherein each of the at least one antenna substrate is further provided with a microstrip feedline on a second side of the substrate, wherein the second side opposites to the first side.

14. The dual-band antenna in accordance with claim 1, wherein the plurality of dipole antennas are arranged communicate an electromagnetic signal with circular polarization.

15. The dual-band antenna in accordance with claim 14, wherein the electromagnetic signal includes a radiation pattern substantially covering the upper hemisphere in both xoz-plane and yoz-plane.

16. The dual-band antenna in accordance with claim 15, wherein the electromagnetic signal includes a 3-dB axial ratio beamwidth broader than 200°.

17. The dual-band antenna in accordance with claim 1, wherein the back cavity structure defines a corrugated back cavity.

18. The dual-band antenna in accordance with claim 17, wherein the back cavity structure comprises a side wall in a corrugated shape.

19. The dual-band antenna in accordance with claim 1, wherein the feed network is provided on a bottom surface of a base of the back cavity structure, the feed network is coupled to the plurality of dipole antennas provided on an opposite surface of the base through a plurality of via structures.

20. The dual-band antenna in accordance with claim 1, wherein the L1 band and the L2 band include a 1.575 Ghz wireless communication band and a 1.227 Ghz wireless communication band respectively.

21. An antenna assembly comprising a plurality of dual-band antenna in accordance with claim 1 arranged in an array.

* * * * *